United States Patent [19]

Sonoda et al.

[11] Patent Number: 4,915,078

[45] Date of Patent: Apr. 10, 1990

[54] FUEL INJECTION CONTROL DEVICE OF AN INTERNAL COMBUSTION ENGINE

[75] Inventors: Yukihiro Sonoda; Kouichi Osawa, both of Susono, Japan

[73] Assignee: Toyota Jidosha Kabushiki Kaisha, Aichi, Japan

[21] Appl. No.: 221,732

[22] Filed: Jul. 20, 1988

[30] Foreign Application Priority Data

Jul. 21, 1987 [JP] Japan ..... 62-181847

[51] Int. Cl.[4] ..... F02D 41/34; F02D 41/10

[52] U.S. Cl. ..... 123/478; 123/492

[58] Field of Search ..... 123/478, 480, 491, 492

[56] References Cited

U.S. PATENT DOCUMENTS 4,463,732 8/1984 Isobe et al. ..... 123/492
4,512,317 4/1985 Pauwels et al. ..... 123/478

FOREIGN PATENT DOCUMENTS 58-25534 2/1983 Japan .
58-28552 2/1983 Japan .
63-65159 3/1988 Japan ..... 123/478
63-147954 6/1988 Japan ..... 123/478

*Primary Examiner*—Andrew M. Dolinar
*Attorney, Agent, or Firm*—Kenyon & Kenyon

[57] ABSTRACT

A fuel injection control device for controlling a synchronous injection time period and an asynchronous injection time period. When the synchronous injection time period calculated from the operating state of the engine exceeds one time period of the synchronous injection, the actual synchronous injection time period is restricted so that it does not exceed one time period of the synchronous injection. When the request for the asynchronous injection occurs during the time the synchronous injection is carried out, the actual synchronous injection time period is prolonged by the asynchronous injection time period.

10 Claims, 13 Drawing Sheets

FUEL INJECTION CONTROL DEVICE OF AN INTERNAL COMBUSTION ENGINE

FIELD OF THE INVENTION

The present invention relates to a fuel injection control device of an internal combustion engine.

DESCRIPTION OF THE RELATED

In a known fuel injection control device of an internal combustion engine, the amount of fuel injected from the fuel injectors is calculated in accordance with the operating state of the engine, and the injection is started at a predetermined crank angle (CA), for example, every 360° CA, and then continues for a time determined by the calculated amount of fuel. An injection thus started at a predetermined crank angle is called a synchronous injection. Furthermore, in the known fuel injection control device, to obtain an easy start of the engine and a good acceleration thereof, in addition to the synchronous injection, an asynchronous injection is carried out to feed additional fuel into the intake passage when the engine is started or accelerated. This asynchronous injection is started independently of the crank angle.

In such a fuel injection control device, the request for starting the asynchronous injection may be received during the time that the synchronous injection is carried out. If this request for an asynchronous injection is ignored, an amount of fuel sufficient to meet the demand of the engine is not fed into the intake passage, and thus a problem arises in that it is impossible to obtain a good operation of the engine. Consequently, in the known fuel injection control device, when the request for the asynchronous injection or the request for the next synchronous injection occurs during the time that the synchronous injection is carried out, the injection time is prolonged by a time determined by those requests (refer to Japanese Unexamined Patent Publication Nos. 58-25534 and 58-150048). Note, when feedback control of the air-fuel ratio is carried out, i.e., a closed loop control is carried out, the basis injection time is usually calculated from the engine load and the engine speed, and the actual injection time is controlled so that the air-fuel ratio becomes equal to a desired air-fuel ratio by correcting the basic injection time by a feedback correction coefficient provided on the basis of a signal output by an oxygen concentration detector arranged in the exhaust passage of the engine.

Conversely, when there is no feedback control of the air-fuel ratio, i.e., when an open loop control is carried out, the basic injection time is also calculated from the engine load and the engine speed but the actual injection time is calculated by correcting the basic injection time by the following various correction coefficients; i.e., an enrichment correction coefficient for obtaining an easy start of the engine; an enrichment correction coefficient for obtaining a good combustion when the temperature of the engine is low; an enrichment correction coefficient for lowering the air-fuel ratio which has necessarily become large due to an increase in the density of air fed into the engine cylinder when the temperature of the air is low; an enrichment correction coefficient for improving the acceleration of the engine; and an enrichment correction coefficient for obtaining a high output power of the engine when the engine is operating under a heavy load.

Consequently, when, for example, the temperature of the engine is low and the engine is accelerated, a plurality of the above-mentioned enrichment corrections are effected at the same time, and thus the amount of fuel per one synchronous injection becomes large, i.e., the injection time per one synchronous injection becomes long. At this time, if the engine is operating at a relatively high speed, the synchronous injection time becomes longer than a usual one time period of the synchronous injection, for example, exceeds 360° CA, and thus the request for the next synchronous injection occurs during the time that this synchronous injection is carried out.

In this case, in the known fuel injection operation, the next synchronous injection time is added to the present synchronous injection time, and as a result, the fuel injection is continuously carried out for a long time. This situation will be hereinafter described with reference to FIG. 11. In FIG. 11, TA indicates the degree of opening of the throttle valve, and N indicates an engine speed. In addition, Q/N indicates (the amount of air Q fed into the engine cylinders)/(engine speed N), i.e., indicates an engine load. Furthermore, FIG. 11 illustrates the case where, after the engine is accelerated, the deceleration of the engine is started at the time X. When the engine is accelerated, and the engine speed becomes high, the request for the next synchronous injection occurs during the time that the synchronous injection is carried out. At this time, since the next synchronous injection time is successively added to the synchronous injection time, the fuel injection is continuously carried out for the time Y in FIG. 11, even after the deceleration of the engine is started. Consequently, during the time Y after the deceleration of the engine is started, the air-fuel mixture fed into the engine cylinders becomes extremely rich, and thus a problem arises in that misfiring and back-firing occur. In addition, another problem arises in that carbon accumulates on the spark plug, and the electric power supplied for an ignition thereof leaks to the ground via the accumulated carbon.

In the known fuel injection control device disclosed in the above-mentioned Japanese Unexamined Patent Publication No. 58-25534, an upper limit is provided for the injection time so that the injection time will not exceed a predetermined fixed time. But, since the crank angle corresponding to this fixed time depends on the engine speed, it is difficult to determine the crank angle at which the injection time can be permitted.

SUMMARY OF THE INVENTION

An object of the present invention is to provide a fuel injection control device capable of feeding fuel in an amount which meets the demand of the engine and is capable of preventing the air-fuel mixture from becoming excessively rich when the engine is decelerated.

According to the present invention, there is provided a fuel injection control device of an engine: a synchronous injection time period (or time) calculating means for calculating a synchronous injection time period in accordance with an operating state of the engine; an injection starting means for starting an actual synchronous injection at a predetermined crank angle; a maximum time period (or time) calculating means for calculating a maximum time period which is not longer than the period between the starting times of successive synchronous injections and which changes to follow the change in the one time period of the synchronous injection; an injection completing means for completing the actual synchronous injection when the synchronous injection time period has elapsed after the actual synchronous injection is started when the synchronous injection time period is shorter than the maximum time period and for completing the actual synchronous injection when the maximum time period has elapsed after the actual synchronous injection is started when the synchronous injection time period exceeds the maximum time period.

The present invention may be more fully understood from the description of preferred embodiments of the invention set forth below, together with the accompanying drawings.

DESCRIPTION OF THE PREFERRED EMBODIMENTS

Figure 1:
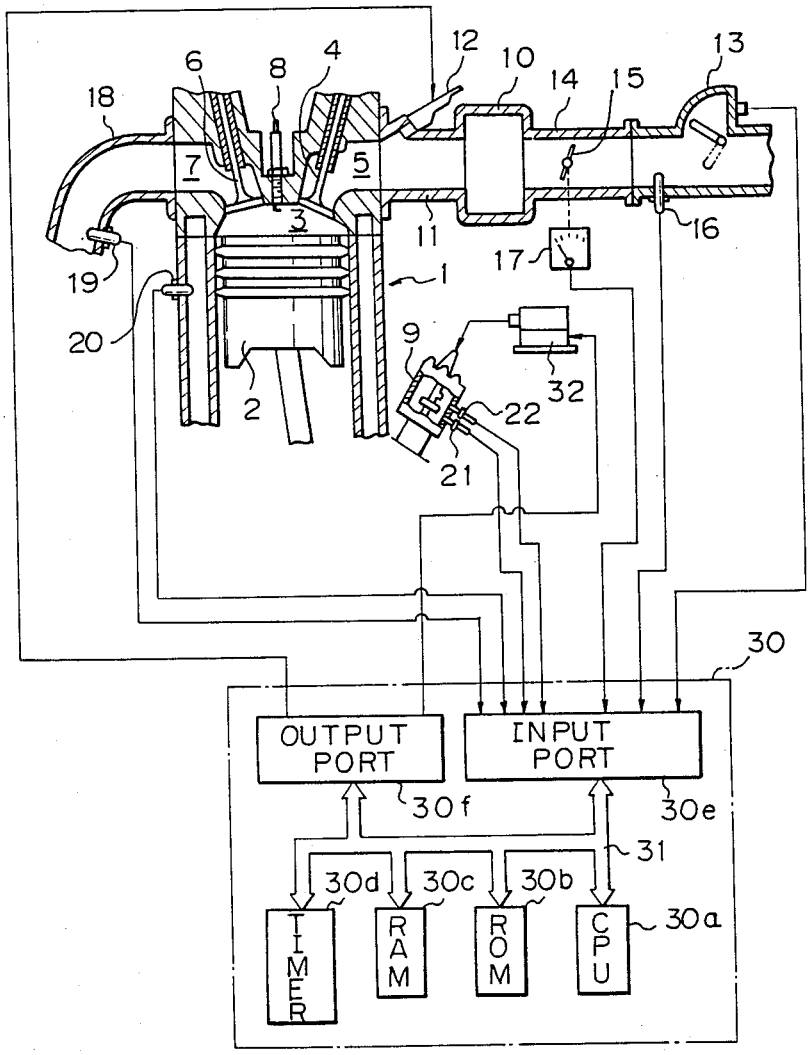
FIG. 1 is a schematic illustration of a cross-sectional view of an engine.

Referring to FIG. 1, reference numeral 1 designates an engine body, 2 a piston, 3 a combustion chamber, 4 an intake valve, 5 an intake port, 6 an exhaust valve, 7 an exhaust port, 8 a spark plug, and 9 a distributor. The intake port 5 is connected to a surge tank 10 via a branch pipe 11, and a fuel injector 12 is arranged in the branch pipe 11. The surge tank 10 is connected to an air flow meter 13 via an intake duct 14, and a throttle valve 15 is arranged in the intake duct 14. The air flow meter 13 is provided for detecting the amount of air fed into the engine cylinders and produces an output signal indicating the amount of air fed therein. A temperature sensor 16 is arranged in the air flow meter 13 to detect the temperature of air fed into the engine cylinders and produces an output signal indicating the temperature of the air. A throttle sensor 17 is attached to the valve shaft of the throttle valve 15 to detect the opening degree of the throttle valve 15 and produces an output signal indicating the degree of opening of the throttle valve 15. An exhaust manifold 18 is connected to the exhaust port 7, and an oxygen concentration detector 19 is arranged in the exhaust manifold 18 to detect whether the air-fuel mixture fed into the engine cylinders is rich or lean, and produces an output signal indicating whether the air-fuel mixture is rich or lean. A temperature sensor 20 is mounted on the engine body 1 to detect the temperature of the cooling water of the engine, and produces an output signal indicating the temperature of the engine cooling water. Crank angle sensors 21 and 22 are mounted on the distributor 9. The crank angle sensor 21 produces an output pulse at each 30 degrees revolution of the crank shaft of the engine, and the crank angle sensor 22 produces an output pulse at each complete revolution of the crank shaft of the engine. The engine speed is calculated from the output pulse of the crank angle sensor 21, and the ignition timing is determined by the output pulse of the crank angle sensor 22. The fuel injector 12 is connected to an electronic control unit 30, and the fuel injection by the fuel injector 12 is controlled by the signals outputted by the electronic control unit 30.

The electronic control unit 30 is constructed as a digital computer and comprises a CPU (microprocessor, etc.) 30*a*, a ROM (read-only memory) 30*b*, a RAM (random access memory) 30*c*, a timer 30*d*, an input port 30*e*, and an output port 30*f*. The CPU 30*a*, the ROM 30*b*, the RAM 30*c*, the timer 30*d*, the input port 30*e* and the output port 30*f* are interconnected to each other via a bidirectional bus 31. The signals outputted by the air flow meter 13, the temperature sensor 16, the throttle sensor 17, the oxygen concentration detector 19, and the temperature sensor 20 are inputted to the input port 30*e*, which also receives pulses outputted by the crank angle sensors 21 and 22. The output port 30*f* is connected to the fuel injector 12 and to the distributor 9, via an ignitor 32. The timer 30*d* includes a free run counter representing a current time and producing an interruption signal at a time set by the CPU 302.

In the present invention, the synchronous injection is started at a predetermined crank angle, for example, every 360° CA. In addition, for example, when the request for the next synchronous injection or the request for the asynchronous injection occurs during the time that the actual injection is carried out, the next synchronous injection time or the asynchronous injection time is added to the actual injection time. At this time, if the sum of the injection times exceeds one time period of the synchronous injection, which corresponds to 360° CA, the actual injection time is restricted so that the actual injection is completed when the one time period of the synchronous injection has elapsed.

Next, the injecting operation according to the present invention is initially described with reference to examples illustrated in FIG. 2. In these examples, the synchronous injection is started at every 360° CA, and Tc indicates one time period of the synchronous injection which corresponds to 360° CA.

Figure 2A:
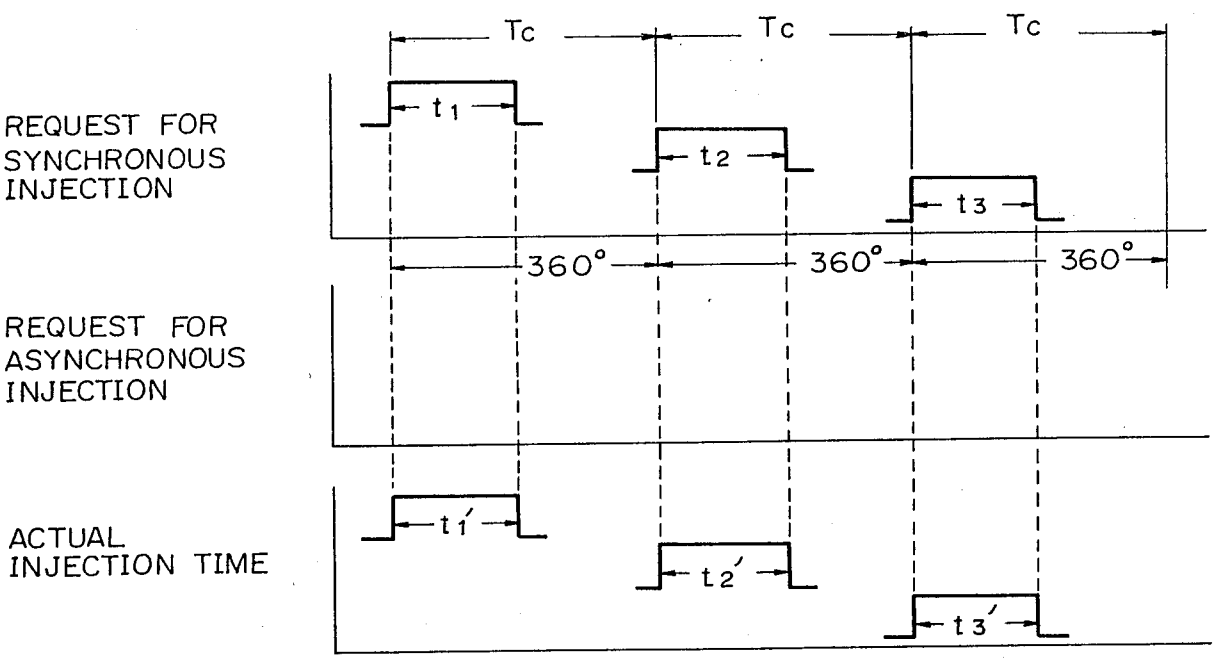
FIG. 2 is a time chart illustrating the requested synchronous injection time, the requested asynchronous injection time and the actual injection time.
Figure 2B:
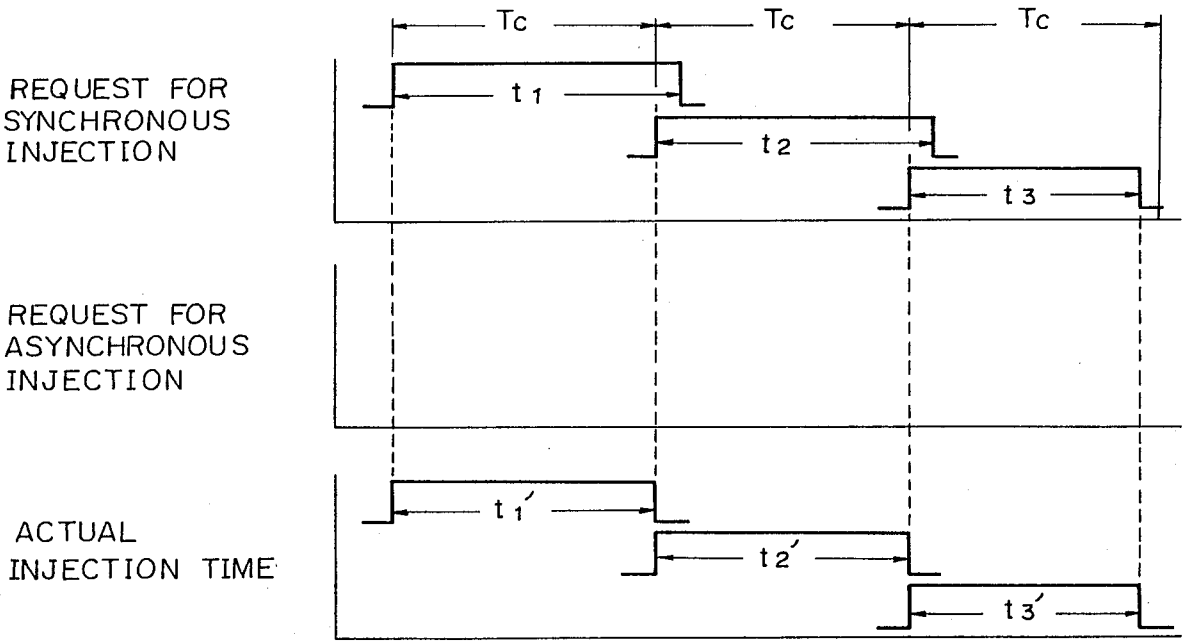
Figure 2:
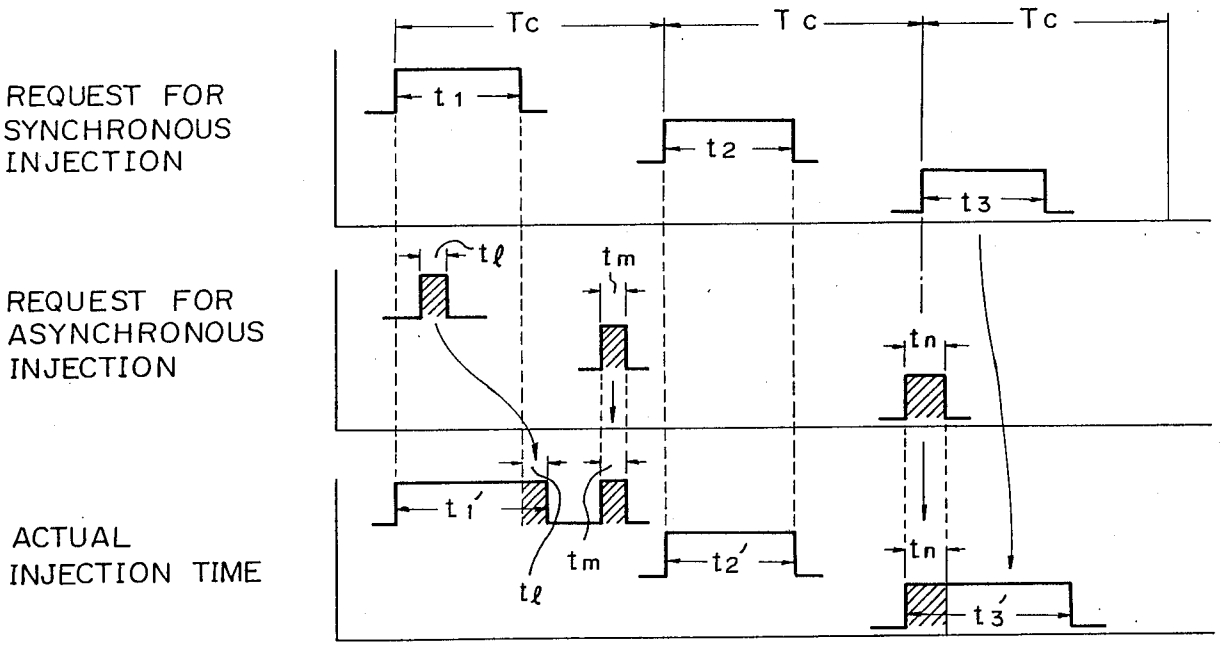
Figure 2D:
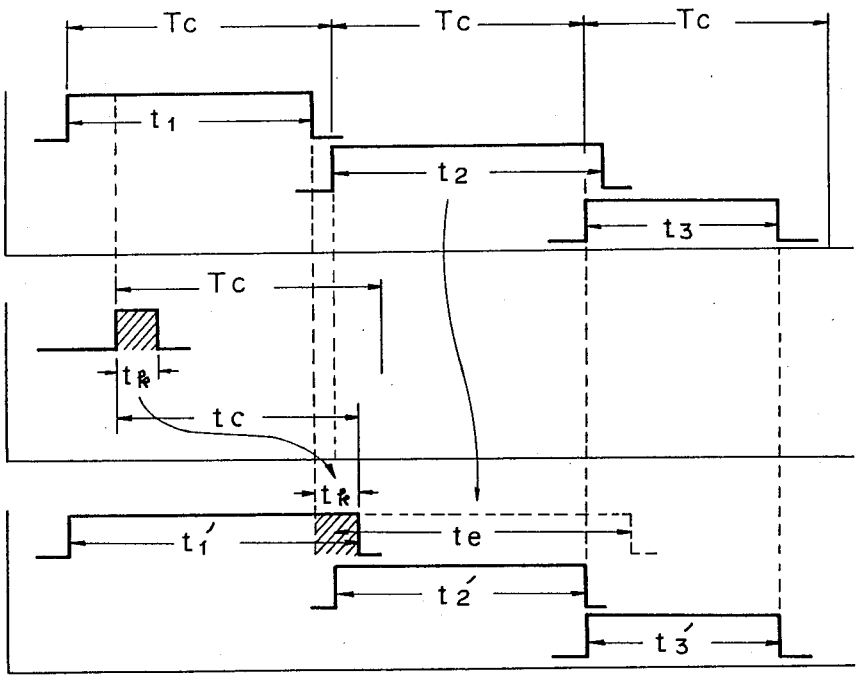
Figure 2E:
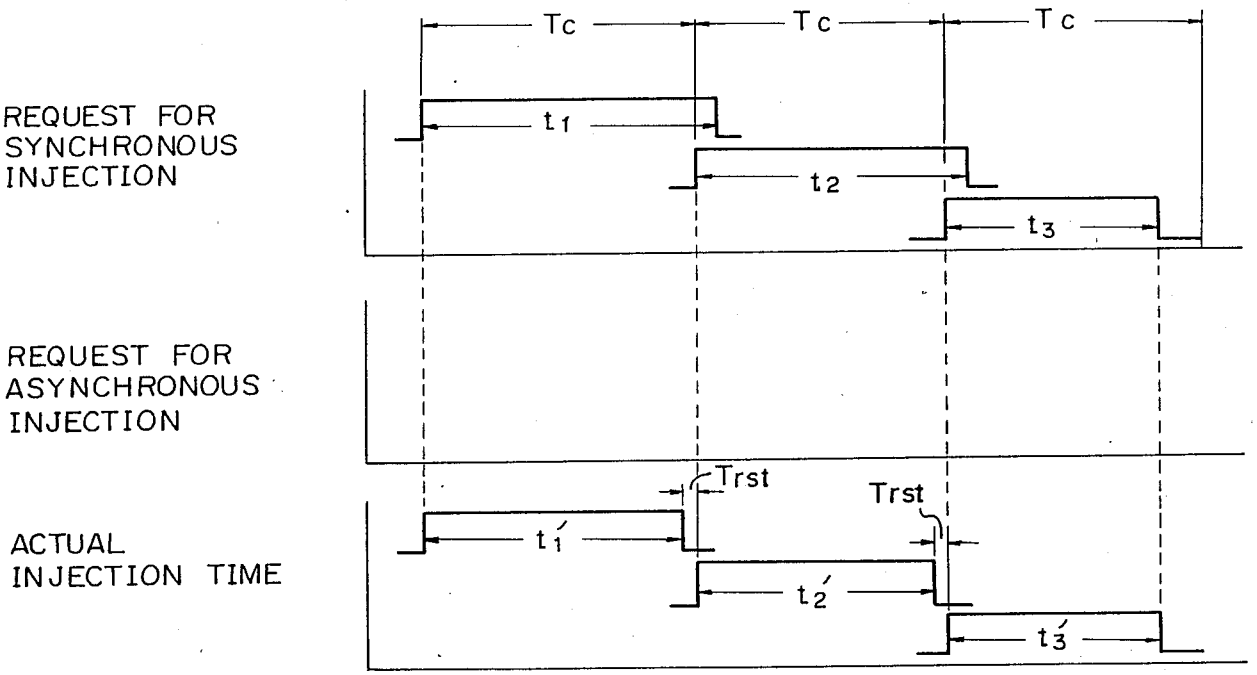

FIG. 2(*a*) illustrates the case where the request for the asynchronous injection does not occur, and where the requested synchronous injection time $t_1$, $t_2$, or $t_3$ is shorter than one time period of the synchronous injection Tc. In this case, when the request for the synchronous injection occurs, the actual injection is started, and the actual injection is stopped at a time determined by the requested synchronous injection times $t_1$, $t_2$, $t_3$. Consequently, in this case, the actual injection times $t_1'$, $t_2'$, $t_3'$ correspond to the requested synchronous injection times $t_1$, $t_2$, $t_3$, respectively.

FIG. 2(*b*) illustrates the case where the request for the asynchronous injection does not occur, and where the requested synchronous injection time $t_1$, $t_2$ exceeds one time period of the synchronous injection Tc. In this case, when the request for the synchronous injection indicated by $t_1$, $t_2$ occurs, the corresponding actual injection times $t_1'$, $t_2'$ are set so that the actual injection is stopped when one time period of the synchronous time Tc has elapsed. Then, when the request for the synchronous injection $t_3$ occurs, since this requested synchronous injection time $t_3$ is shorter than the one time period of the synchronous injection Tc, the actual injection time $t_3'$ corresponds to the required synchronous injection time $t_3$, and thus the actual injection is continuously carried out during the times $t_1'$, $t_2'$ and $t_3'$ and is stopped when the time $t_3'$ has elapsed. Consequently, when the engine is decelerated, and thus the requested synchronous injection time is injection time is shortened accordingly, as shown by $t_3'$ in FIG. 2(*b*). Consequently, when the engine is decelerated, it is possible to prevent the air-fuel mixture from becoming extremely rich.

FIG. 2(*c*) illustrates the case where the request for the asynchronous injection occurs, i.e., when the request for the asynchronous injection t occurs during the time that the synchronous injection $t_1$ is carried out, the actual injection time $t_1'$ is obtained by adding the requested synchronous injection time $t_1$ and the asynchronous injection time t ; namely, the actual injection time $t_1'$ is prolonged by the time t . Subsequently, when the request for the asynchronous injection $t_m$ occurs during the time that the actual injection is stopped, the actual injection is started when the request for the asynchronous injection $t_m$ occurs, and then the actual injection is stopped when the requested asynchronous injection time $t_m$ has elapsed. Subsequently, when the request for the synchronous injection $t_2$ occurs, the actual injection is carried out during the time $t_2'$, which corresponds to the requested synchronous injection time $t_2$. When the request for the asynchronous injection $t_n$ occurs, the actual fuel injection is started. Then, when the request for the synchronous injection $t_3$ occurs during the time that the asynchronous injection $t_n$ is carried out, the actual injection time $t_3'$ is obtained by adding the asynchronous injection time $t_n$ and the requested synchronous injection time $t_3$, i.e., the actual injection time $t_3$, is prolonged by the time $t_3$. Consequently, if the request for the asynchronous injection occurs, since the amount of fuel injected from the fuel injector 12 is increased, it is possible to feed the fuel in an amount which meets the demand of the engine.

FIG. 2(*d*) illustrates a special case wherein the calculated actual injection time exceeds one time period of the synchronous injection Tc. Namely, as mentioned above, when the request for the asynchronous injection $t_k$ occurs during the time that the actual injection is carried out, the actual injection time $t_1'$ is obtained by adding the requested synchronous injection time $t_1$ and the requested asynchronous injection time $t_k$. At this time, even if the calculated actual injection time $t_1'$ exceeds one time period of the synchronous injection Tc, the actual injection time $t_1'$ is prolonged by the time $t_k$ as long as the time difference $t_c$ between the occurrence of the request for the asynchronous injection $t_k$ and the completion of the calculated actual injection time $t_1'$ is shorter than one time period of the synchronous injector Tc. Consequently, in this case, the request for the next synchronous injection $t_2$ occurs during the time that the actual injection is carried out, and at this time, the calculated actual injection time is obtained by adding the time $t_1'$ and the requested synchronous injection time $t_2$. Nevertheless, at this time, if the time difference $t_e$ between the occurrence of the request for the synchronous injection and the completion of the calculated actual injection time exceeds one time period of the synchronous injection Tc, the actual injection time is restricted so that the actual injection is stopped when one time period of the synchronous injection Tc has elapsed. Consequently, at this time, in practice, the actual injection time becomes equal to one time period of the synchronous injection Tc, as shown by $t_2'$ in FIG. 2(*d*), and thus the actual injection time $t_2'$ lasts until the time that the request for the next synchronous injection $t_3$ occurs. Consequently, if the requested synchronous injection time $t_3$ is shorter than one time period of the synchronous injection Tc, the actual injection time $t_3'$ becomes shorter than one time period of the synchronous injection Tc.

FIGS. 3 through 6 are flow charts illustrating the execution of the fuel injection control shown in FIG. 2.

Figure 3:
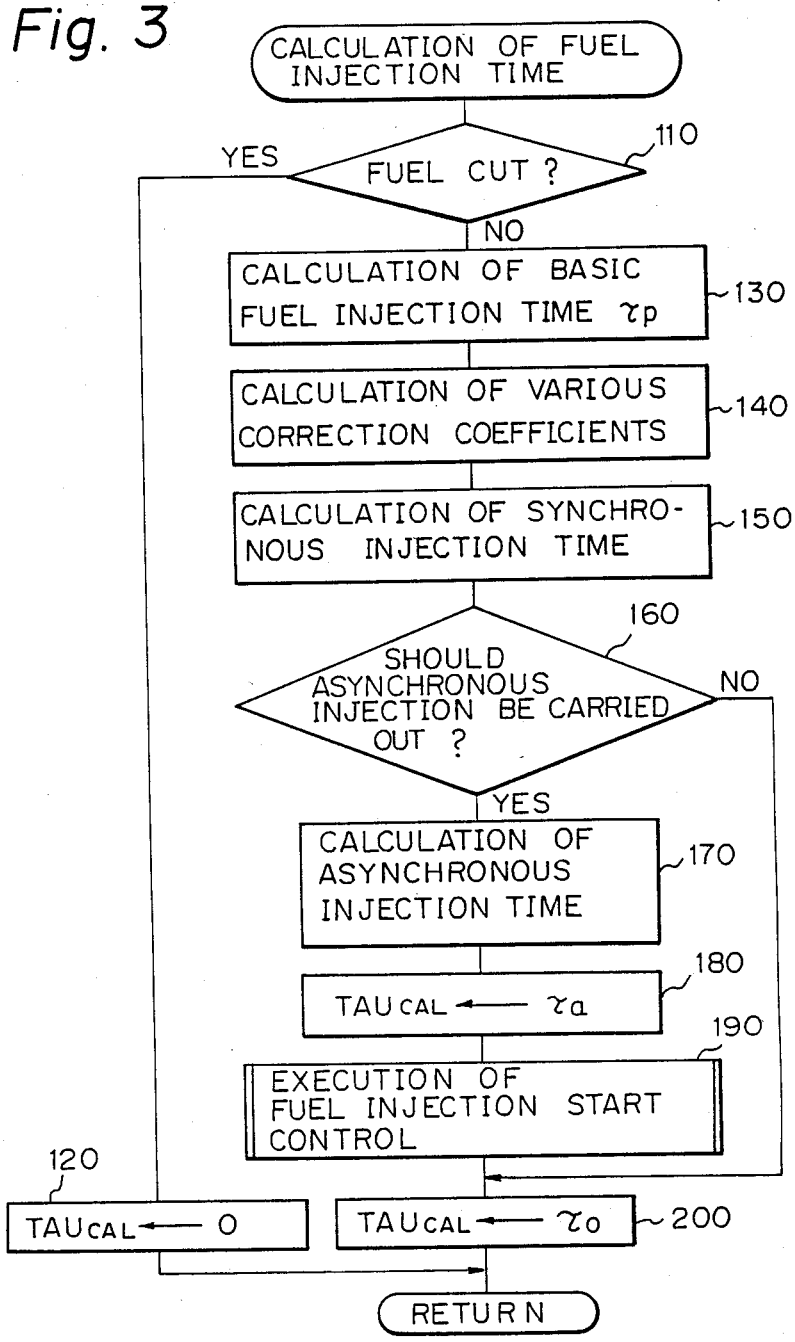
FIG. 3 is a flow chart for executing the calculation of the fuel injection time.

FIG. 3 illustrates a routine for calculating the fuel injection time. This routine is processed by sequential interruptions which are executed at predetermined intervals, for example, every 4 msecs.

Referring to FIG. 3, in step 110, it is determined whether or not the supply of fuel from the fuel injector 12 should be cut, on the basis of the signals outputted by the throttle sensor 17 and the crank angle sensor 21, and when the engine speed N is higher than a predetermined speed, and the throttle valve 15 is in the idling position, it is determined that the supply of fuel should be cut. At this time, the routine goes to step 120, and the fuel injection time $TAU_{cal}$ becomes equal to zero.

Conversely, when it is determined in step 110 that the supply of fuel should not be cut, the routine goes to step 130, and the basic fuel injection time $\tau_p$ for the synchronous injection is calculated on the basis of the signals outputted by the air flow meter 13 and the crank angle sensor 21. The relationship among the basic fuel injection time $\tau_p$, the engine speed N, and the amount of air Q fed into the engine cylinders is stored in the ROM 30*b* in the form of, for example, a map, and thus the basic fuel injection time $\tau_p$ for the synchronous injection is calculated from the map. Then the routine goes to step 140, and the following various correction coefficients are calculated on the basis of the signals outputted by the temperature sensor 16, the throttle sensor 17, the oxygen concentration detector 19, and the temperature sensor 20.

(1) An enrichment correction coefficient f(THA) changed in accordance with a change in the temperature of air fed into the engine cylinders.

(2) An enrichment correction coefficient f(WL) changed in accordance with the warm-up state of the engine.

(3) An enrichment correction coefficient f(POWER) for increasing the output power of the engine when the engine is operating under a heavy load.

(4) An enrichment correction coefficient f(AEW) becoming large when the engine is accelerated.

(5) A feedback correction coefficient f(A/F) changed in response to the output signal of the oxygen concentration detector 19.

The routine then goes to step 150, and the synchronous injection time $\tau_0$ is calculated from the following equation.

$$\tau_0=\tau_p \cdot f(A/F) \cdot f(WL) \cdot f(THA) \cdot \{(1+f(ASW)+f(\mathrm{POWER})\}$$

Note, when the open loop control should be carried out, f(A/F) becomes equal to 1.0 in the above equation, and when the closed loop control should be carried out, f(WL) and f(THA) become equal to 1.0 and f(ASW) and f(POWER) become equal to zero in the above equation.

Figure 4:
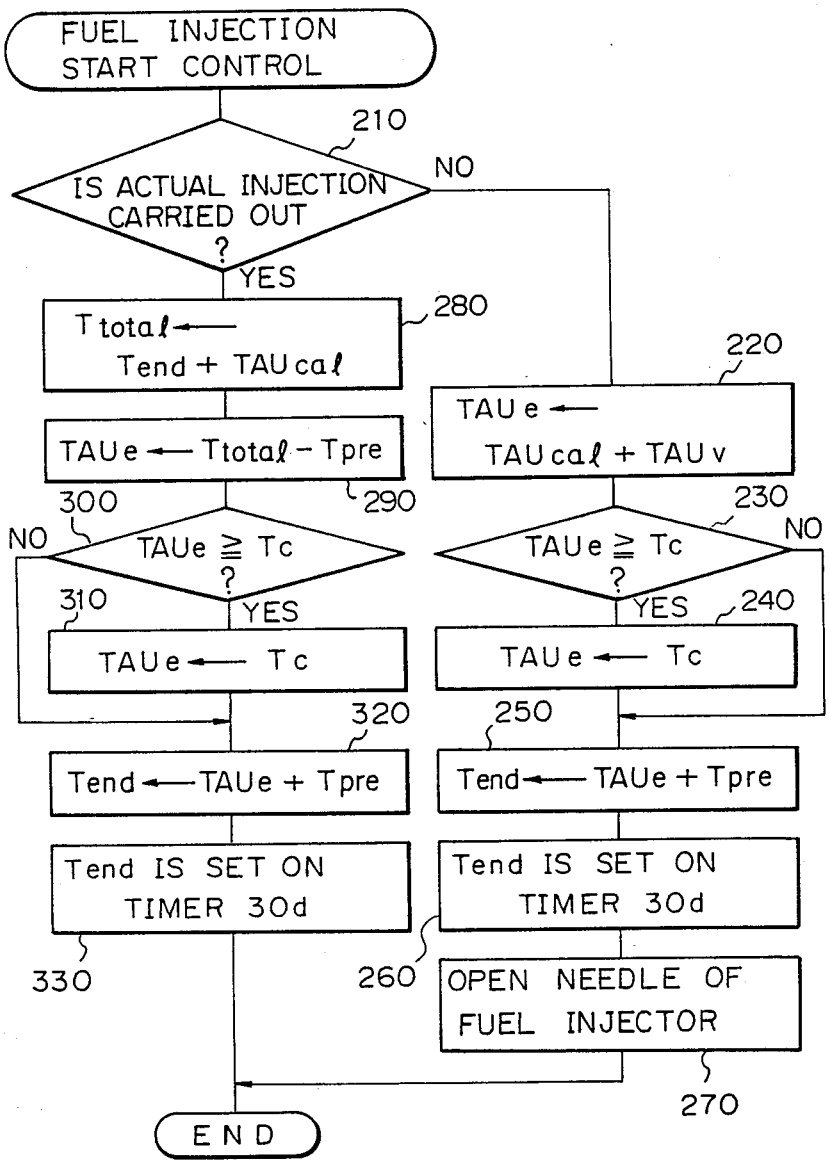
FIG. 4 is a flow chart for executing the fuel injection start control.

The routine then goes to step 160, and it is determined whether or not the asynchronous injection should be carried out. This asynchronous injection is carried out when, for example, the engine is accelerated. Consequently, for example, in step 160, the difference between the degree of opening of the throttle valve $\alpha(k-1)$ in the preceding processing cycle and the degree of opening of the throttle valve $\alpha(k)$ in the present processing cycle is obtained on the basis of the output signal of the throttle sensor 17, and when the difference $\{\alpha(k)-\alpha(k-1)\}$ exceeds a predetermined value, it is determined that the engine is accelerated, and thus the asynchronous injection should be carried out. When it is determined, in step 160, that the asynchronous injection should be carried out, the routine goes to step 170. In step 170, the asynchronous injection time $\tau_a$, which is the most suitable for the operating state of the engine, is calculated on the basis of, for example, the engine speed N and the temperature of the cooling water THW of the engine. Then, in step 180, the asynchronous injection time $\tau_a$ is memorized as the fuel injection time $TAU_{cal}$, and the routine goes to step 190, and a hereinafter described fuel injection start control illustrated in FIG. 4 is executed. When the fuel injection start control is completed, the routine goes to step 200, and the synchronous injection time $\tau_0$ obtained in step 150 is memorized as the fuel injection time $TAU_{cal}$.

Conversely, when it is determined in step 160 that the asynchronous injection should not be carried out, the routine jumps to step 200, and the synchronous injection time $\tau_0$ obtained in step 150 is memorized as the fuel injection time $TAU_{cal}$.

FIG. 4 illustrates a routine for executing the fuel injection start control. This routine is basically processed by sequential interruptions executed at every 360° CA, and further processed when it is determined that the asynchronous injection should be carried out in step 160 of FIG. 3, and thus the routine goes to the step 190 of FIG. 3.

Referring to FIG. 4, in step 210, it is determined whether or not the fuel injector 12 is operated, i.e., an actual injection is carried out. When the actual injection is not carried out, the routine goes to step 220. In step 220, the ineffective injection time TAUv is added to the fuel injection time $TAU_{cal}$ obtained by the routine illustrated in FIG. 3, and the result of the addition is memorized as the actual injection time $TAU_e$. Then, the routine goes to step 230.

In step 230, it is determined whether or not the actual injection time $TAU_e$ is longer than one time period of the synchronous injection Tc illustrated in FIG. 2. If $TAU_e \geqq Tc$, the routine goes to step 240, and one time period of the synchronous injection Tc is memorized as the actual injection time $TAU_e$; i.e., the actual injection time $TAU_e$ is restricted so that it does not exceed Tc, and the routine then goes to step 250. Conversely, if $TAU_e < Tc$, the routine jumps to step 250. In step 250, the actual injection time $TAU_e$ is added to the current time $T_{pre}$, and the result of the addition is memorized as the fuel injection completion time $T_{end}$ In step 260, the fuel injection completion time $T_{end}$ is set to the timer $30_d$, and then, in step 270, the needle of the fuel injector 12 is opened and the actual injection is started.

As will be understood from the above description, when the actual injection time $TAU_e$ represents the synchronous injection time and is shorter than one time period of the synchronous injection Tc, the actual injection is carried out during the calculated actual injection time $TAU_e$, as illustrated in FIG. 2(*a*). Conversely, when the actual injection time $TAU_e$ exceeds Tc, since the actual injection time $TAU_e$ is restricted so that it does not exceed Tc, the actual injection is carried out during Tc, as illustrated in FIG. 2(*b*). In addition, when the actual injection time $TAU_e$ represents the asynchronous injection time and is shorter than Tc, the actual injection is carried out during the actual injection time $TAU_e$, as illustrated by $t_m$ in FIG. 2(*c*).

In step 210 of FIG. 4, when it is determined that the actual injection is carried out, the routine goes to step 280. In step 280, the fuel injection time $TAU_e$ obtained in the routine illustrated in FIG. 3 is added to the fuel injection completion time $T_{end}$ set to the timer 30*d*, and the result of the addition is memorized as the fuel injection complete time $T_{total}$. This $T_{total}$ represents a provisional fuel injection completion time which is prolonged by the fuel injection time $TAU_{cal}$, which is calculated by the routine in FIG. 3 in response to the request for the synchronous or the asynchronous injection. Then, in step 290, the current time $T_{pre}$ is subtracted from the fuel injection completion time $T_{end}$, and the result of the subtraction is memorized as the actual injection time $TAU_e$. Then, in step 300, it is determined whether or not the actual injection time $TAU_e$ is longer than one time period of the synchronous injection Tc. If $TAU_e \geqq Tc$, one time period of the synchronous injection Tc is memorized as the actual injection time $TAU_e$, and the routine goes to step 320. Conversely, if $TAU_e < Tc$, the routine jumps to step 320. In step 320, the current time $T_{pre}$ is added to the actual injection time $TAU_e$ obtained in step 290 or 310, and the result of the addition is memorized as the fuel injection completion time $T_{end}$. Then, in step 330, the fuel injection completion time $T_{end}$ is set to the timer 30*d*.

As will be understood from the above description, when the request for the asynchronous injection occurs during the time that the actual injection is carried out, and thus, when the fuel injection time $TAU_{cal}$ in step 280 represents the asynchronous injection time, the fuel injection completion time $T_{end}$ is prolonged by the fuel injection time $TAU_{cal}$, the actual injection time is prolonged by the requested asynchronous injection time $TAU_{cal}$ as long as the actual injection time $TAU_e$ in step 290 does not exceed Tc, as illustrated by $t_l$ in FIG. 2(*c*) and by $t_k$ in FIG. 2(*d*). Conversely, when the request for the synchronous injection occurs during the time that the actual injection is carried out, and thus the fuel injection time $TAU_{cal}$ represents the synchronous injection, the actual injection time is prolonged by the requested synchronous injection time $TAU_{cal}$ as long as the actual injection time $TAU_e$ in step 290 does not exceed Tc, as illustrated by $t_3$ in FIG. 2(*c*). In addition, as illustrated by $t_1'$ and $t_2$ in FIG. 2(*d*), when the request for the next synchronous injection occurs during the time that the actual injection is carried out, and when the actual injection time $TAU_e$ in step 290, i.e., $t_e$ in FIG. 2(*d*), exceeds Tc, the actual injection time becomes equal to tc, as illustrated by $t_2'$ in FIG. 2(*d*).

Figure 5:
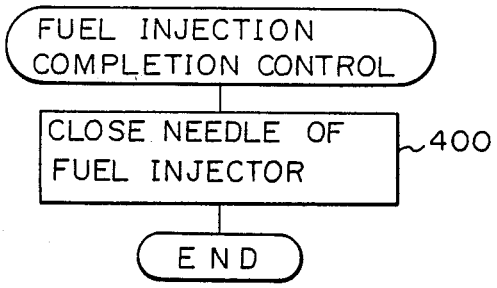
FIG. 5 is a flow chart for executing the fuel injection completion control.

FIG. 5 illustrates a routine for executing the fuel injection completion control. This routine is processed by an interruption signal output from the timer 30*d*.

Namely, as mentioned above, in steps 260 and 330 of FIG. 4, the fuel injection completion time $T_{end}$ is set to the timer 30*d*, and when the current time becomes equal to the fuel injection completion time $T_{end}$, the interruption signal is output from the timer 30*d*. At this time, the routine illustrated in FIG. 5 is executed, and in step 400, the needle of the fuel injector 12 is closed, i.e., the actual injection is stopped.

Figure 6:
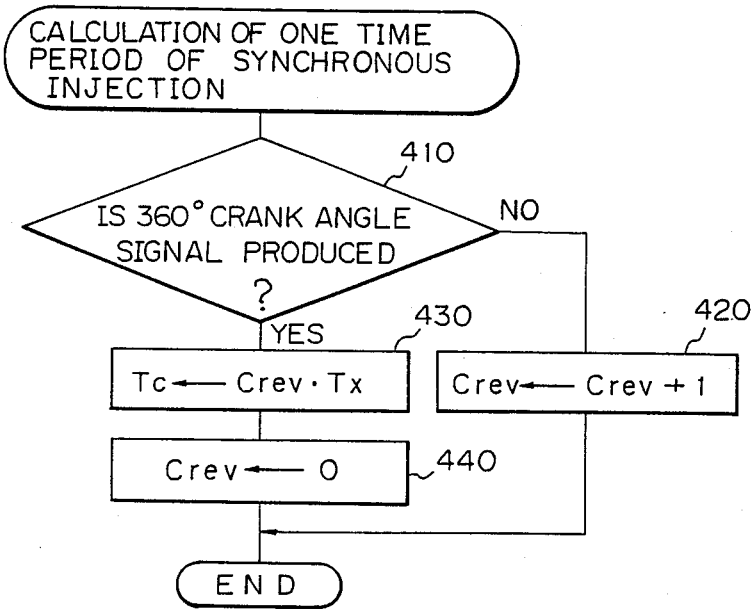
FIG. 6 is a flow chart for executing the calculation of a one time period of the synchronous injection.

FIG. 6 illustrates a routine for executing the calculation of one time period of the synchronous injection Tc. This routine is processed by sequential interruptions which are executed at predetermined intervals, for example, every 4 msecs.

Referring to FIG. 6, in step 410, it is determined whether or not the crank angle sensor 22 produces an output pulse at every 360° CA. If the crank angle sensor 22 does not produce such an output signal, the routine goes to step 420, and the count value $C_{rev}$ is incremented by one. Conversely, when it is determined in step 410 that the crank angle sensor 22 produces the output signal, the routine goes to step 430. In step 430, the count value $C_{rev}$ is multiplied by the interruption interval $T_X$ (=4 msecs), and the result of the multiplication is memorized as one time period of the synchronous injection Tc, and then, in step 440, the count value is cleared.

Figure 7:
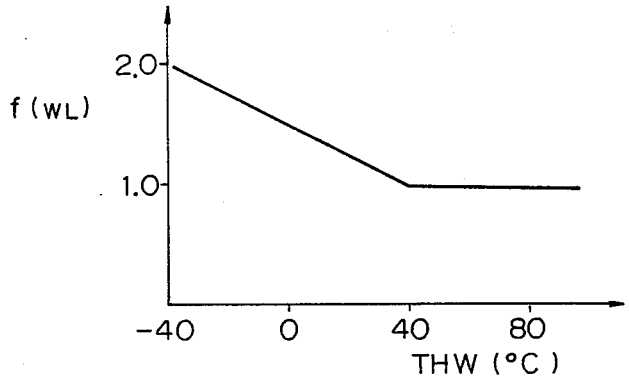
FIG. 7 is a diagram illustrating the relationship between the enrichment correction coefficient and the temperature of the engine cooling water.

FIG. 7 illustrates the relationship between the enrichment correction coefficient f(WL) and the temperature of the engine cooling temperature THW (°C.). As can be seen from FIG. 7, the enrichment correction coefficient f(WL) becomes considerably large when the temperature of the engine cooling water THW is low.

Figure 8:
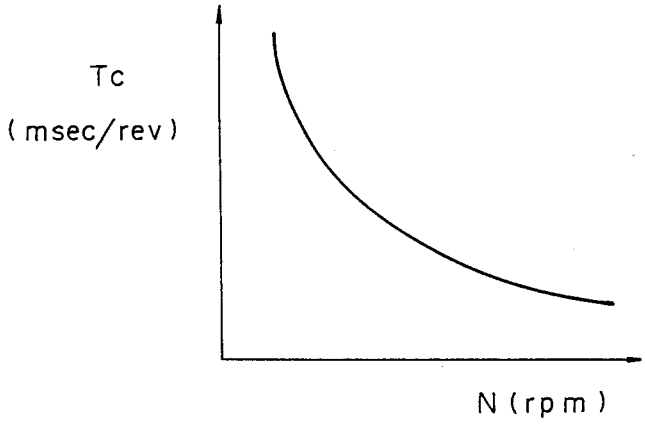
FIG. 8 is a diagram illustrating the relationship between the engine speed and a one time period of the synchronous injection.

FIG. 8 illustrates the relationship between the engine speed N (r.p.m.) and one time period of the synchronous injection Tc. As can be seen from FIG. 8, the one time period of the synchronous injection Tc is rapidly reduced as the engine speed N is increased.

In addition, the above-mentioned enrichment coefficient f(POWER) becomes a large value which is more than 1.0 when the engine is operating under a heavy load.

Figure 9:
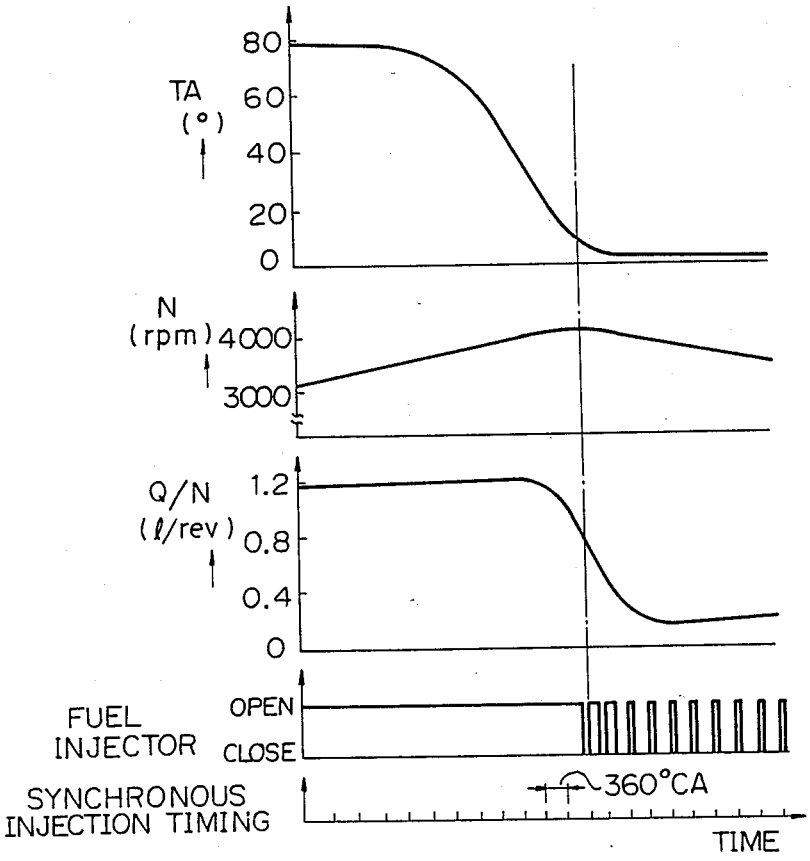
FIG. 9 is a time chart illustrating the injecting operation according to the present invention.
Figure 11:
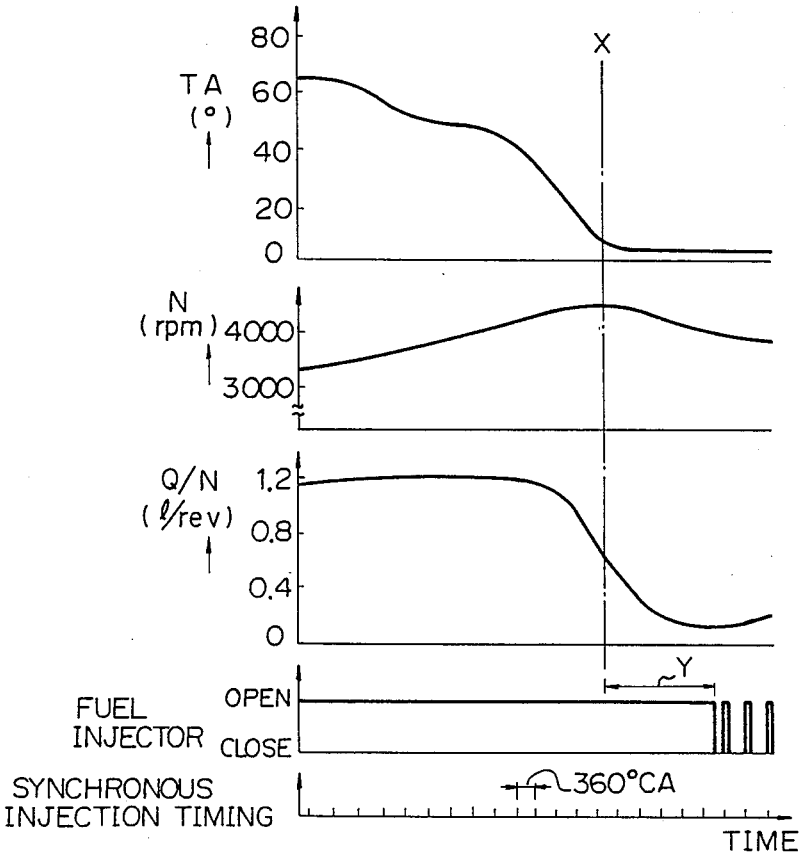
Fig. 11 ( PRIOR ART )

Consequently, when the temperature of the engine cooling water THW is low, if the engine is operating at a high speed under a heavy load, the requested synchronous injection time exceeds one time period of the synchronous injection Tc. But at this time, in the present invention, the actual injection time is restricted so that it does not exceed one time period of the synchronous injection Tc, as illustrated in FIG. 2(*b*). Consequently, when the requested synchronous injection time becomes short as illustrated by $t_3$ in FIG. 2(*b*), the actual injection time accordingly becomes short as illustrated by $t_3'$ in FIG. 2(*b*). Therefore, as illustrated in FIG. 9, when deceleration of the engine is started at a time X, the amount of fuel injected from the fuel injector 12 is instantaneously decreased, and thus it is possible to prevent the air-fuel mixture from becoming extremely rich. In FIG. 9, note that TA indicates the degree of opening of the throttle valve, and N indicates an engine speed, and further, Q/N indicates an engine load, as mentioned previously with reference to FIG. 11.

In addition, as mentioned above, when the engine is accelerated, and the request for the asynchronous injection occurs, the actual injection time is prolonged and the actual injection is carried out during the requested asynchronous injection time, as illustrated in FIG. 2(*c*), and as a result, it is possible to obtain a good acceleration of the engine.

In the embodiment hereinbefore described, when the calculated actual injection time $TAU_e$ exceeds one time period of the synchronous injection Tc, the actual injection time is determined so that it becomes equal to Tc. But, when the calculated actual injection time $TAU_e$ exceeds Tc, the actual injection time may be determined so that it becomes equal to a maximum time which is slightly smaller than Tc by a fixed time $T_{rst}$, as illustrated in FIG. 2(*e*).

Figure 10:
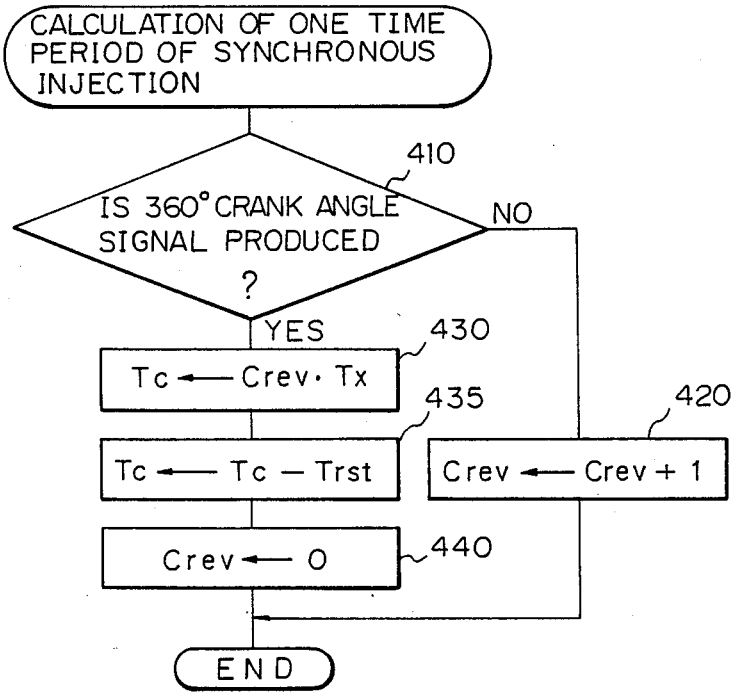
FIG. 10 is a flow chart of an alternative embodiment for executing the calculation of a one time period of the synchronous injection; and, FIG. 11 is a time chart illustrating the injecting operation carried out by the prior art injection system.

FIG. 10 illustrates a flow chart for executing the above-mentioned control of the actual injection time. Steps 410, 420, 430, and 440 of FIG. 10 are the same as steps 410, 420, 430, and 440 of FIG. 6, respectively, and thus a description of these steps is omitted. In FIG. 10, the difference lies in that an additional step 435 is inserted between steps 430 and 440. In step 435, the fixed time $T_{rst}$ is subtracted from the actual one time period of the synchronous injection Tc, and the result of the subtraction is memorized as a one time period of the synchronous injection Tc. In this case, even when the requested synchronous injection time exceeds the actual one time period of the synchronous time Tc, it is possible to close the needle of the fuel injector 12 and stop the operation thereof for the fixed time $T_{rst}$. As a result, it is possible to improve the lift time of the fuel injector 12.

In addition, the present invention has been described with reference to the embodiment in which the fuel is injected for all cylinders at the same time at each complete revolution of the crankshaft of the engine. But, the present invention may be applied to a group injection system, in which the cylinders are divided into two groups, and in which the fuel is injected for each group of the cylinders at each two revolutions of the crankshaft of the engine.

According to the present invention, when the request for the asynchronous injection occurs, since the amount of fuel injected from the fuel injector is increased, it is possible to obtain a good acceleration of the engine. In addition, when the deceleration of the engine is started, since the amount of fuel injected from the fuel injector is instantaneously decreased, it is possible to prevent the air-fuel mixture from becoming excessively rich. As a result, it is possible to prevent misfiring and back-firing, and to prevent an accumulation of carbon on the spark plug, and thus prevent a leakage of electric power supplied for the ignition thereof.

While the invention has been described by reference to specific embodiments chosen for purposes of illustration, it should be apparent that numerous modifications could be made thereto by those skilled in the art without departing from the basic concept and scope of the invention.

I claim:

1. A fuel injection control device of an engine comprising:

synchronous injection time period calculating means for calculating a synchronous injection time period in accordance with an operating state of the engine;

injection starting means for starting an actual synchronous injection at a predetermined crank angle;

maximum time period calculating means for calculating a maximum time period which is not longer than the period between the starting times of successive synchronous injections and which changes to follow said period between the starting times of successive synchronous injections;

injection completing means for completing said actual synchronous injection when said synchronous injection time period has elapsed after said actual synchronous injection is started, when said synchronous injection time period is shorter than said maximum time period, and for completing said actual synchronous injection when said maximum time period has elapsed after said actual synchronous injection is started when said synchronous injection time period exceeds said maximum time period.

2. A fuel injection control device according to claim 1, wherein said maximum time period is equal to said period between the starting times of successive synchronous injections.

3. A fuel injection control device according to claim 1, wherein said maximum time period is slightly shorter than said period between the starting times of successive synchronous injections.

4. A fuel injection control device according to claim 3, wherein said maximum time period is shorter than said period between the starting times of successive synchronous injections by a predetermined fixed time.

5. A fuel injection control device according to claim 1, further comprising request producing means for producing a request for an asynchronous injection in accordance with an operating state of the engine, and asynchronous injection time period calculating means for calculating an asynchronous injection time period in accordance with an operating state of the engine, said injection starting means starting an actual asynchronous injection when said request for the asynchronous injection occurs when said actual synchronous injection is not carried out, said injection completing means completing said actual asynchronous injection when said asynchronous injection time period has elapsed after said request for the asynchronous injection occurs when a crank angle is not the same as said predetermined crank angle during said asynchronous injection time period.

6. A fuel injection control means according to claim 5, wherein an actual injection time period becomes equal to the sum of said synchronous injection time period and said asynchronous injection time period when said asynchronous injection time period and said asynchronous injection time period overlap each other.

7. A fuel injection control device according to claim 6, wherein said injection starting means starts an actual injection at said predetermined crank angle when said request for the asynchronous injection occurs during said synchronous injection time period, and said injection completing means completes said actual injection when said actual injection time period has elapsed after said actual injection is started as long as said actual injection time period does not overlap a next synchronous injection time period when a time difference between a time at which said request for the asynchronous injection occurs and a time at which the sum of said synchronous injection time period and said asynchronous injection time period elapses is shorter than said maximum time period, said injection completing means completing said actual injection when said maximum time period has elapsed after said actual injection is started as long as said actual injection time period does not overlap the next synchronous injection time period when said time difference exceeds said maximum time.

8. A fuel injection control device according to claim 6, wherein said injection starting means starts an actual injection when said request for the asynchronous injection occurs when the crank angle is the same as said predetermined crank angle during said asynchronous injection time period, and said injection completing means completes said actual injection when said actual injection time period has elapsed after said actual injection is started as long as said actual injection time period does not overlap a next asynchronous injection time period when a time difference between a time at which the crank angle is the same as said predetermined crank angle and a time at which the sum of said synchronous injection time period and said asynchronous injection time period elapses is shorter than said maximum time period, said injection completing means completing said actual injection when said maximum time period has elapsed after said actual injection is started as long as said actual injection time period does not overlap the next synchronous injection time period when said time difference exceeds said maximum time period.

9. A fuel injection control device according to claim 5, wherein said request producing means produces said request for the asynchronous injection when the engine is accelerated.

10. A fuel injection control device according to claim 5, wherein said asynchronous injection time period is determined on the basis of an engine speed and a temperature of an engine coolant.

* * * * *

UNITED STATES PATENT AND TRADEMARK OFFICE

CERTIFICATE OF CORRECTION

PATENT NO. : 4,915,078

DATED : Apr. 10, 1990

INVENTOR(S) : Y. SONODA, et al.

It is certified that error appears in the above-identified patent and that said Letters Patent is hereby corrected as shown below:

Column 1, line 9, change "DESCRIPTION OF THE RELATED" to --DESCRIPTION OF THE RELATED ART--.

Column 5, line 14, delete the second "injection time is".

Column 5, line 15, between "shortened" and "accordingly" insert --as shown by $t_3$ in FIG. 2(b), the actual injection time is shortened--.

Column 6, line 66, delete the parenthesis before "1+".

Column 11, line 49, change "asynchronous" to --synchronous--.

Column 12, line 30, change "asynchronous" to --synchronous--.

Signed and Sealed this

Fourth Day of February, 1992

*Attest:*

HARRY F. MANBECK, JR.

*Attesting Officer*

*Commissioner of Patents and Trademarks*